US005291999A

United States Patent [19]

Phair

[11] Patent Number: 5,291,999

[45] Date of Patent: Mar. 8, 1994

[54] CHRISTMAS TREE BAG

[76] Inventor: Walter E. Phair, 15445 39th La. South, Seattle, Wash. 98188

[21] Appl. No.: 962,700

[22] Filed: Oct. 19, 1992

[51] Int. Cl.[5] ..... B65D 85/50; B65D 33/28

[52] U.S. Cl. ..... 206/423; 383/72; 383/76; 383/907

[58] Field of Search ..... 206/423; 150/154; 383/7, 61, 72, 76, 907

[56] References Cited

U.S. PATENT DOCUMENTS

| | | | |
|---|---|---|---|
| 1,253,269 | 1/1918 | Moeller | 383/907 |
| 2,497,325 | 2/1950 | Scherba | 383/75 |
| 2,616,467 | 11/1952 | Cicero | 383/75 |
| 2,781,811 | 2/1957 | Dilar et al. | 206/423 |
| 2,911,025 | 11/1959 | Paros | 206/423 |
| 3,727,656 | 4/1973 | Luders | 383/907 |
| 3,893,359 | 5/1975 | Khanna et al. | 383/76 |
| 3,954,129 | 5/1976 | Rudell et al. | 206/423 |
| 4,054,166 | 10/1977 | Burke | 206/423 |
| 4,799,520 | 1/1989 | Blackburn et al. | 206/423 |
| 4,802,773 | 2/1989 | Gross | 383/7 |

*Primary Examiner*—Steven N. Meyers
*Assistant Examiner*—M. D. Patterson
*Attorney, Agent, or Firm*—Michael I. Kroll

[57] ABSTRACT

A Christmas tree bag for a cut evergreen tree is provided which consists of a flexible cone shaped enclosure having an entrance, so that the evergreen tree can be inserted therein. A structure is for sealing the entrance of the flexible cone shaped enclosure to prevent needles from the foliage of the evergreen tree to exit therefrom, especially when being transported from one location to another.

6 Claims, 2 Drawing Sheets

CHRISTMAS TREE BAG

BACKGROUND OF THE INVENTION

1. Field of the Invention

The instant invention relates generally to baggage and more specifically it relates to a Christmas tree bag.

2. Description of the Prior Art

Numerous baggage have been provided in prior art that are adapted to include trunks, bags, parcels and suitcases in which people carry their belongings while traveling. While these units may be suitable for the particular purpose to which they address, they would not be as suitable for the purposes of the present invention as heretofore described.

SUMMARY OF THE INVENTION

A primary object of the present invention is to provide a Christmas tree bag that will overcome the shortcomings of the prior art devices.

Another object is to provide a Christmas tree bag which will enclose an evergreen tree for transportation, so that the needles and secretions from the tree will not be deposited therefrom during transportation before and after the Christmas season.

An additional object is to provide a Christmas tree bag that will serve as a skirt decoration underneath the tree, so that Christmas presents may be placed onto the top of the skirt decoration.

A further object is to provide a Christmas tree bag that is simple and easy to use.

A still further object is to provide a Christmas tree bag that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
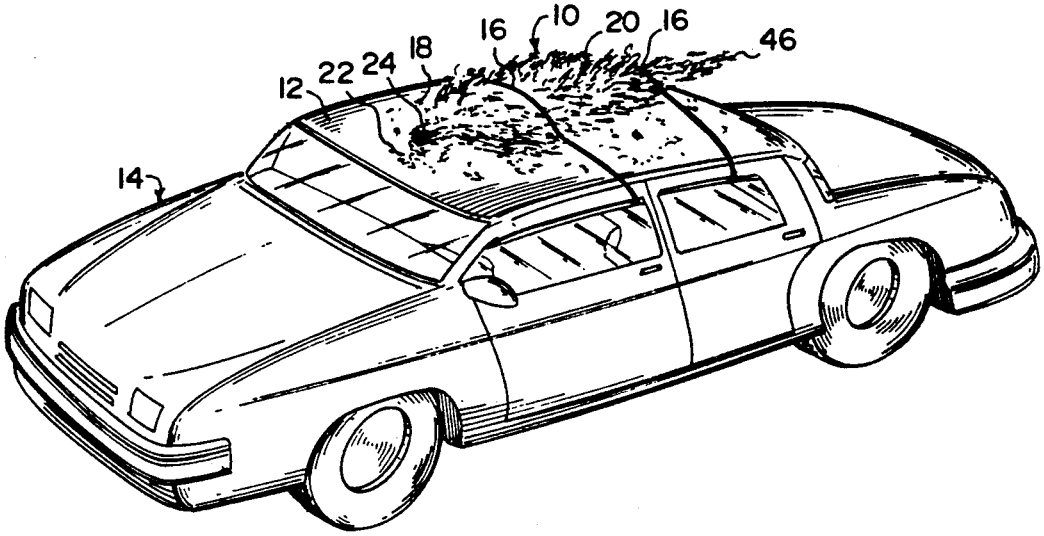
Fig. 1 (PRIOR ART)
FIG. 1 is a perspective view of the prior art showing a cut evergreen tree being transported on top of a motor vehicle.

Turning now descriptively to the drawings, in which similar reference characters denote similar elements throughout the several views, FIG. 1 illustrates the prior art. An evergreen tree 10 is being carried on a roof 12 of a motor vehicle 14 by tie down straps 16. The needles 18 form foliage 20 and secretions 22 from a cut tree trunk end 24 are going all over the roof 12 of the motor vehicle 14.

The instant invention shown in FIGS. 2 through 7, is a Christmas tree bag 26 for the cut evergreen tree 10, which consists of a flexible cone shaped enclosure 28 having an entrance 30, so that the evergreen tree 10 can be inserted therein. A structure 32 is for sealing the entrance 30 of the flexible cone shaped enclosure 28, to prevent the needles 18 from the foliage 20 of the evergreen tree 10 to exit therefrom, especially when being transported from one location to another.

The flexible cone shaped enclosure 28 includes a plurality of triangular shaped panels 34 which are attached together, so as to extend about the foliage 20 of the evergreen tree 10. The sealing structure 32 is an elongated slide fastener 36 which extends from a top end 38 to a bottom end 40 of the flexible cone shaped enclosure 28.

The top casing 42 is attached at the top end 38 of the flexible cone shaped enclosure 28. A top drawstring 44 extends through the top casing 42, which when pulled will cause the top casing 42 to tighten about the top end 38 above an apex 46 of the evergreen tree 10.

Figure 2:
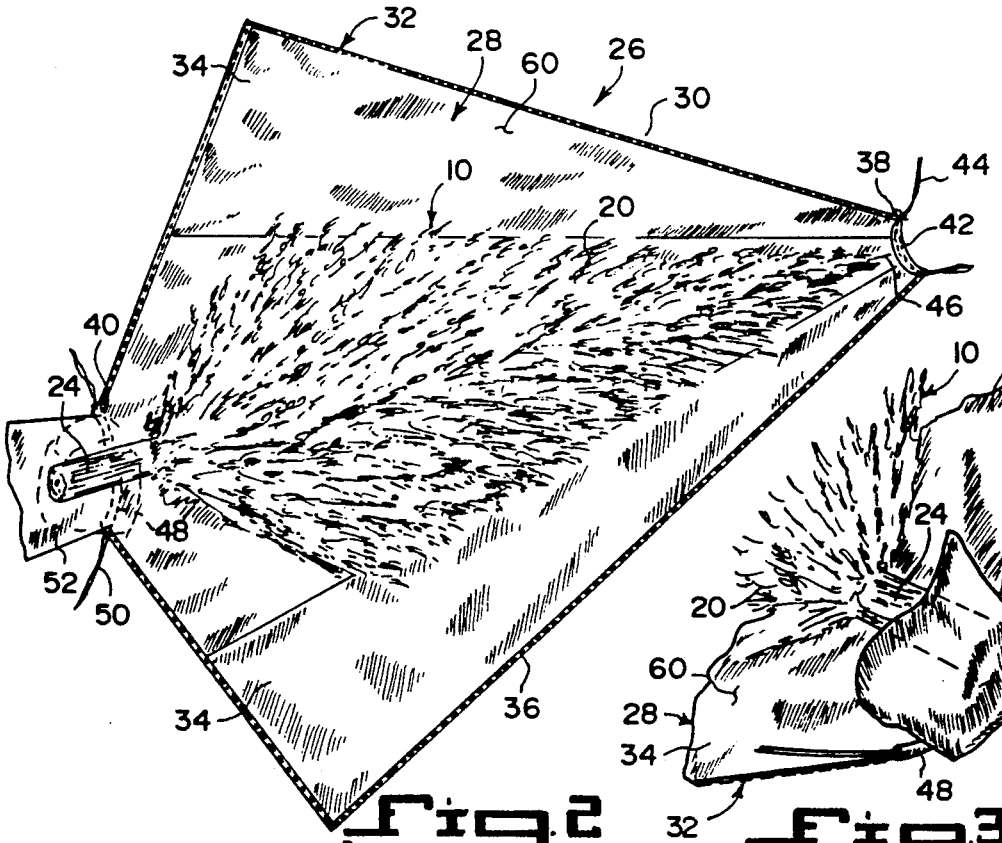
FIG. 2 is a plan view of a first embodiment of the instant invention before being secured about the cut evergreen tree.
Figure 3:
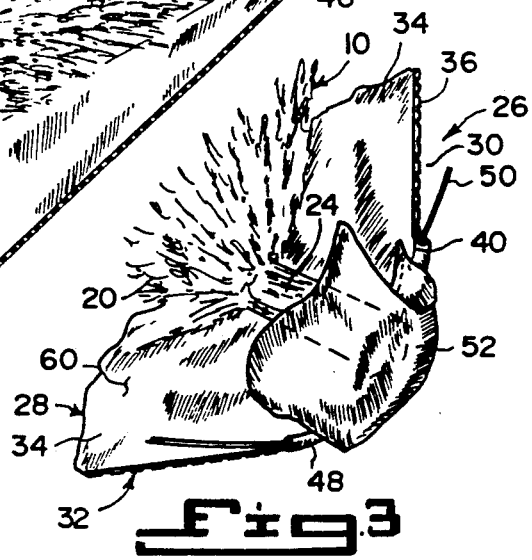
FIG. 3 is a perspective view of a portion of the first embodiment showing the extension flap folded over the cut tree trunk end.

In the first embodiment, as shown in FIGS. 2 and 3, a bottom casing 48 is attached at a center of the bottom end 40 of the flexible cone shaped enclosure 28. A bottom drawstring 50 extends through the bottom causing 48, which when pulled will cause the bottom casing 48 to tighten about the cut tree trunk end 24 of the evergreen tree 10.

An extension flap 52 is secured at one end to the bottom casing 48. The extension flap 52 can be folded over the cut tree trunk end 24 of the evergreen tree 10, to prevent secretions 22 to exit therefrom, especially when being transported from one location to another.

Figure 4:
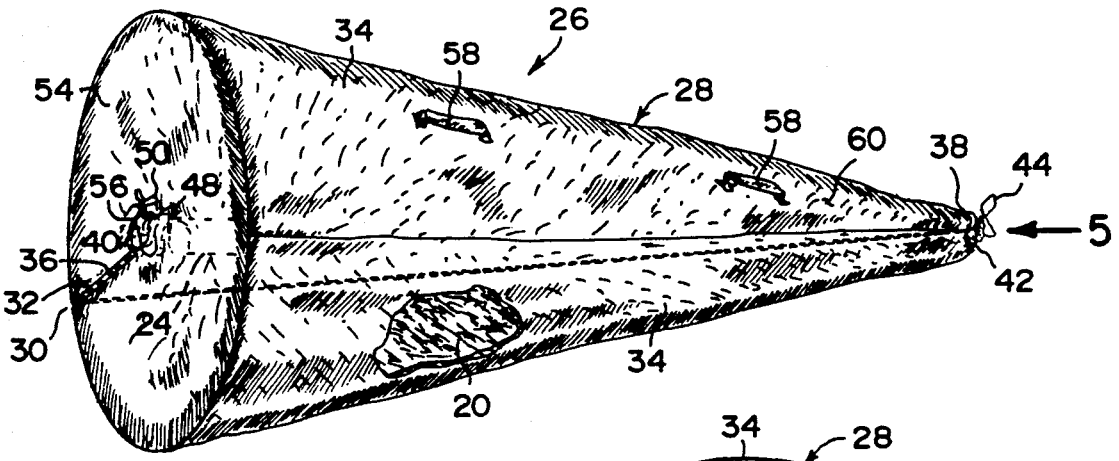
FIG. 4 is an end bottom perspective view of a second embodiment of the instant invention, after being secured about the cut evergreen tree.
Figure 5:
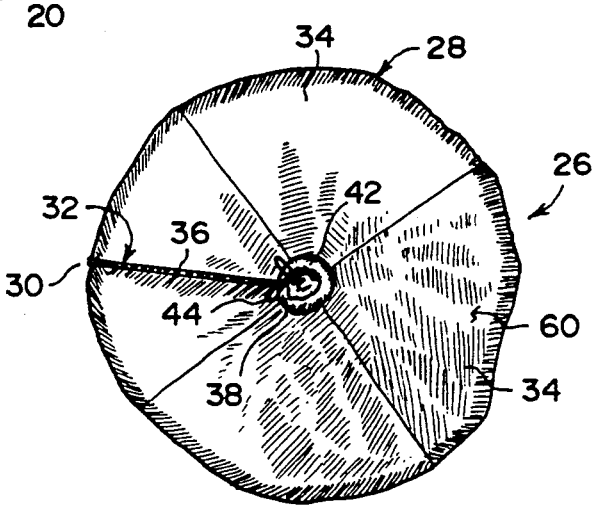
FIG. 5 is a top view taken in direction of arrow 5 in FIG. 4.

In the second embodiment, as shown in FIGS. 4 and 5, a circular base panel 54 is provided having a central aperture 56, in which the elongated slide fastener 36 terminates at the circular base panel 54 and is attached to the bottom edges of each of the triangular shaped panels 34. The bottom casing 48 is now attached about the central aperture 56 of the circular base panel 54, while the bottom drawstring 50 also extends through the bottom casing 48, which when pulled will tighten about the central aperture 56 of the circular base panel 54, to prevent the secretions 22 from a cut tree trunk end 24 of the evergreen tree 10 to exit therefrom, especially when being transported form one location to another.

The Christmas tree bag 26 can further include at least one handle 58 affixed to one of the triangular shaped panels 34, so that the flexible cone shaped enclosure 28 with the evergreen tree 10 therein can be lifted and carried by the at least one handle 58.

In the Christmas tree bag 26, as shown in FIG. 2 and 3, each triangular shaped panel 34, the top casing 42, the bottom casing 48 and the extension flap 52 are all typically, but not limited to, be fabricated out of an upholstery fabric material 60. In the Christmas tree bag 26, as shown in FIGS. 4 and 5, each triangular shaped panel 34, the circular base panel 54, the top casing 42, the bottom casing 48 and the at least one handle 58 are all typically, but not limited to, be fabricated out of an upholstery fabric material 60.

Figure 6:
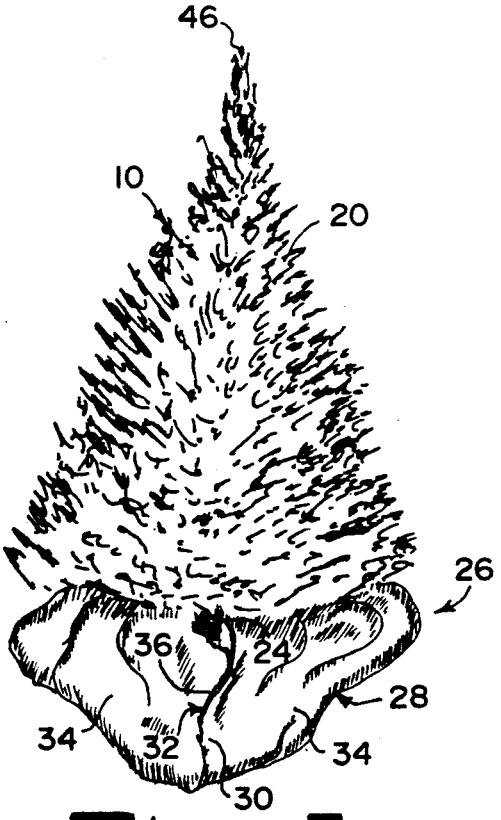
FIG. 6 is a perspective view showing the instant invention being used as a skirt decoration underneath the tree.
Figure 7:
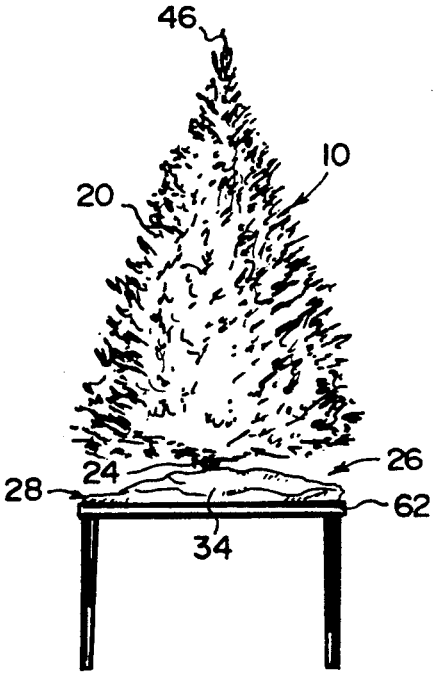
FIG. 7 is an elevational view similar to FIG. 6, but placed upon a table.

After the evergreen tree 10 is removed from the flexible cone shaped enclosure 28, the flexible cone shaped enclosure can be collapsed, as shown in FIG. 6. It can then be placed about the upright cut tree trunk end 24 to be utilized as a skirt decoration, so that Christmas presents may be placed onto the to of the skirt decoration. If the evergreen tree 10 is small, it can then be supported upon a table 62 shown in FIG. 7, with the collapsed flexible cone shaped enclosure 28 thereon, also to act as the skirt decoration.

The flexible cone shaped enclosure 28 can come in various sizes to accommodate various sized evergreen trees 10. It can also be made in various colors and durable materials, to enhance its appearance and its usefulness in preventing the spread of the needles 18 and secretions 22 from the evergreen tree 10.

LIST OF REFERENCE NUMBERS

10 evergreen tree
12 roof
14 motor vehicle
16 tie down strap
18 needles
20 foliage of 10
22 secretions
24 cut tree trunk end
26 Christmas tree bag
28 flexible cone shaped enclosure
30 entrance in 28
32 sealing structure in 30
34 triangular shaped panel in 28
36 elongated slide fastener
38 top end of 28
40 bottom end of 28
42 top casing
44 top drawstring
46 apex of 10
48 bottom casing
50 bottom drawstring
52 extension flap
54 circular base panel
56 central aperture
58 handle
60 upholstery fabric material It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the ar without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A Christmas tree bag for a cut down evergreen tree which comprises:

a) a flexible cone shaped enclosure having an entrance, so that the evergreen tree can be inserted therein, said flexible cone shaped enclosure includes a plurality of triangular shaped panels which are attached together, so as to extend about the foliage of the evergreen tree;

b) means for sealing the entrance of said flexible cone shaped enclosure to prevent needles from the foliage of the evergreen tree to exit therefrom, especially when being transported from one location to another, said sealing means is an elongated slide fastener, which extends from a top end to a bottom end of said flexible cone shaped enclosure;

c) a top casing attached at the top end of said flexible cone shaped enclosure, and a top drawstring extending through said top casing, which when pulled will cause said top casing to tighten about the top end above an apex of the evergreen tree;

d) a bottom casing attached at a center of the bottom end of said flexible cone shaped enclosure, and a bottom drawstring extending through said bottom casing, which when pulled will cause said bottom casing to tighten about a cut tree trunk end of the evergreen tree; and e) an extension flap being secured to said bottom casing, so that said extending flap can be folded over the cut tree trunk end of the evergreen tree to prevent secretions from exiting therefrom, especially when being transported from one location to another.

2. A Christmas tree bag as recited in claim 1, further including a circular base panel having a central aperture in which said elongated slide fastener terminates at, whereby said circular base panel is attached to the bottom edges of each of said triangular shaped panels.

3. A Christmas tree bag as recited in claim 2, further including:

a) a bottom casing attached about the central aperture of said circular bas panel; and b) a bottom drawstring extending through said bottom casing which when pulled will tighten about the central aperture of said circular base panel, to prevent secretions from a cut tree trunk end of the evergreen tree to exit therefrom, especially when being transported from one location to another.

4. A Christmas tree bag as recited in claim 3, further including at least one handle affixed to one of said triangular shaped panels, so that said flexible cone shaped enclosure with the evergreen tree therein can be lifted and carried by said at least one handle.

5. A Christmas tree bag as recited in claim 1, wherein each said triangular shaped panel, said top casing, said bottom casing and said extension flap are all typically, but not limited to, be fabricated out of an upholstery fabric material.

6. A Christmas tree bag as recited in claim 4, wherein each said triangular shaped panel, said circular base panel, said top casing, said bottom casing and said at least one handle are all typically, but not limited to, be fabricated out of an upholstery fabric material.

* * * * *